US007140520B1

(12) United States Patent
Rutler

(10) Patent No.: US 7,140,520 B1
(45) Date of Patent: Nov. 28, 2006

(54) SPIGOT FOR A BEVERAGE DISPENSER

(75) Inventor: Jay B. Rutler, Olathe, KS (US)

(73) Assignee: Rutland, Inc., Olathe, KS (US)

( * ) Notice: Subject to any disclaimer, the term of this patent is extended or adjusted under 35 U.S.C. 154(b) by 80 days.

(21) Appl. No.: 10/990,072

(22) Filed: Nov. 15, 2004

(51) Int. Cl.
*B67D 3/00* (2006.01)

(52) U.S. Cl. ..... 222/511; 222/185.1; 222/509; 222/518; 137/903; 251/335.2

(58) Field of Classification Search ..... 222/185.1, 222/518, 509, 511; 251/335.2; 137/903
See application file for complete search history.

(56) References Cited

U.S. PATENT DOCUMENTS 125,086 A * 3/1872 Rowe ..... 251/322
2,047,764 A * 7/1936 Beggs ..... 251/270
2,644,664 A * 7/1953 Hansen ..... 137/329.05
2,713,988 A * 7/1955 Kitterman ..... 251/322
3,584,834 A * 6/1971 Reid et al. ..... 251/321
3,730,224 A * 5/1973 Prisk ..... 137/625.33
4,624,662 A * 11/1986 Le ..... 604/249
4,693,400 A * 9/1987 Frahm et al. ..... 222/518
4,942,976 A * 7/1990 Spencer ..... 222/153.14

* cited by examiner

*Primary Examiner*—Patrick Brinson
(74) *Attorney, Agent, or Firm*—Erickson & Kleypas, L.L.C.

(57) ABSTRACT

A spigot for a beverage container includes a body having a passage with first and second ends formed therethrough. An annular shoulder extends into the passage proximate the first end thereof and an annular valve seat is formed proximate the second end. An elastomeric plunger positioned in the passage includes a button with a sealing flange seated against the annular shoulder and a valve head biased against the valve seat. The body further includes a plurality of fins extending radially into the passage, each fin has a first end adjacent the annular shoulder such that the first ends contact the sealing flange as the button is depressed. The fins act to inhibit the sealing flange from coming unseated from the shoulder.

16 Claims, 5 Drawing Sheets

SPIGOT FOR A BEVERAGE DISPENSER

BACKGROUND OF THE INVENTION

1. Field of the Invention

This invention relates to spigots for beverage dispensers of the type used for serving iced tea (including sun tea), margaritas, sangria, and the like.

2. Description of the Related Art

A common type of spigot used for dispensing beverages from containers such as sun tea jars, margarita buckets, and the like includes a body having a threaded male connector for installation into an opening formed in a lower portion of an outer wall of the container. A horizontal passage extending through the connector communicates with a vertical passage having top and bottom ends. An elastomeric plunger extends through the vertical passage. The top end of the plunger includes a button and a sealing flange which seals the upper end of the vertical passage. The lower end of the plunger includes a valve head which seals against a valve seat formed in the lower end on the vertical passage. Pushing downwardly on the button causes the valve head to move away from the valve seat and thereby allows a beverage to flow out of the beverage container. The sealing flange further acts as a spring to move the valve head back into sealing engagement with the valve seat when the button is released.

A problem with this prior art spigot is that an excessive or off-center force applied to the button can cause an edge of the sealing flange to be pushed downwardly into the vertical passage, thereby creating a gap between the sealing flange and the body. This gap will cause the beverage to leak out of the container, or, in some cases, to spray outwardly and onto the user. This is especially prone to happen when alcoholic beverages are being served and the users' motor skills may be adversely affected.

What is needed is an improved spigot which has means to prevent the edge of the sealing flange from being pushed into the vertical passage so that such spills can be avoided.

SUMMARY OF THE INVENTION

The present invention comprises a spigot having means formed on the body for supporting the sealing flange when the button is depressed, such that the sealing flange is prevented from coming unseated from the shoulder. The means for supporting the sealing flange preferably comprises a plurality of fins which extend radially into the vertical passage. Each fin has an upper end which contacts the underside of the sealing flange as the button is depressed.

DETAILED DESCRIPTION OF THE PREFERRED EMBODIMENTS

Figure 1:
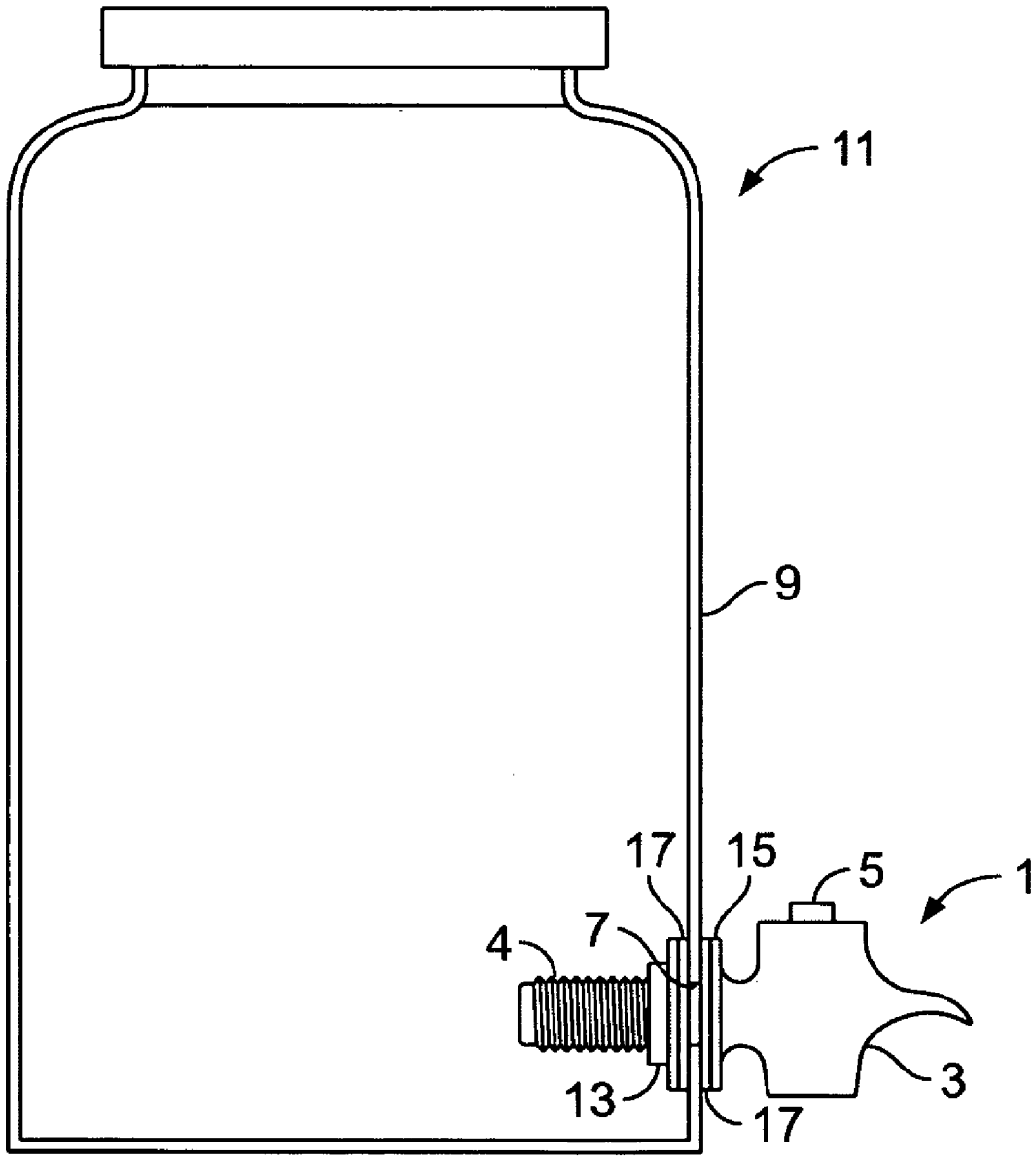
FIG. 1 (Prior Art)
FIG. 1 is a perspective view showing a prior art spigot installed in a beverage container.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, and in particular to FIG. 1, the reference number 1 generally designates a prior art spigot 1 which includes a body 3 and an elastomeric plunger 5. The body 3 includes a threaded male connector 4 for installation into an opening 7 formed in a lower portion of an outer wall 9 of a tea jar, margarita bucket or similar beverage container 11. The connector 4 threadably receives a nut 13 which is adapted to be tightened into abutting relationship with an inner surface of the outer wall 9. A connector flange 15 extends radially outwardly from the connector 4 and abuts against an outer surface of the wall 9 as the nut 13 is tightened. Elastomeric gaskets 17 may be interposed between the wall 9 and the nut 13, as well as between the wall 9 and flange 15 to produce a waterproof seal.

Figure 2:
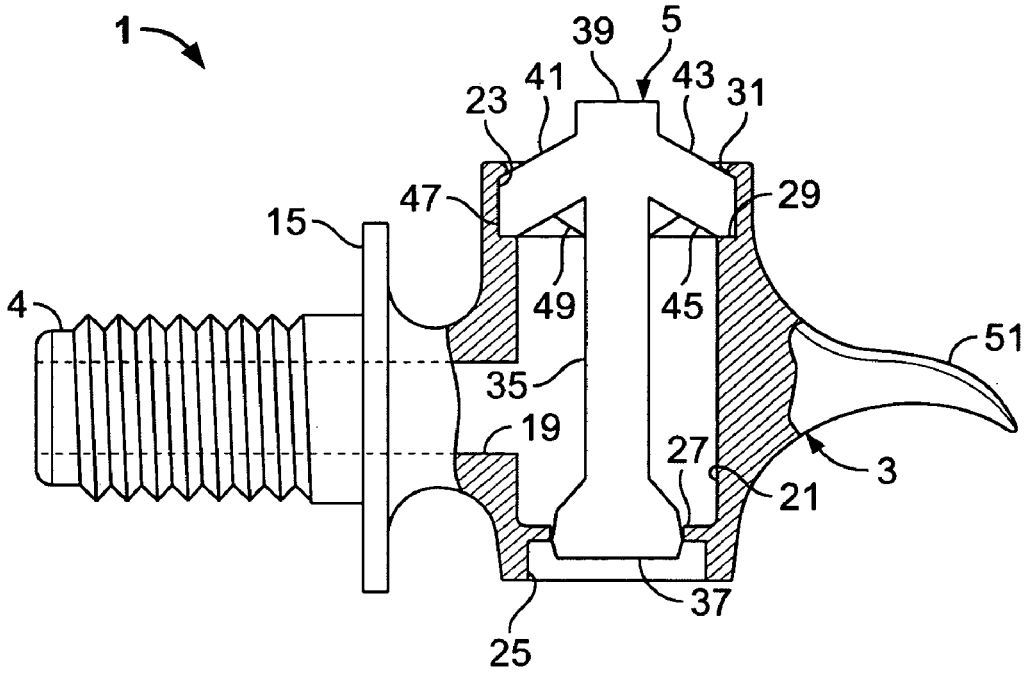
FIG. 2 (Prior Art)
FIG. 2 is a side view of a prior art spigot broken away to show its plunger in the closed position

Referring to FIG. 2, a horizontal passage 19 extends through the connector 4 and communicates with a vertical passage 21 having a top end 23 and a bottom end 25. An annular valve seat 27 is formed on the body 3 proximate the bottom end 25 of the vertical passage 21. A annular shoulder or shelf 29 is formed on the body 3 proximate the top end 23 of the vertical passage 21. Spaced slightly above the shelf 29 is annular detent ring 31.

The plunger 5 is formed of an elastomeric material and includes a shaft 35 having a valve head 37 formed at its lower end and a button 39 formed at its upper end. The button 39 includes a sealing flange 41 having an upper surface 43, a lower surface 45 and an outer edge 47. Gussets 49 are circumferentially spaced around the shaft 35 and are connected to the lower surface 45 of the sealing flange 41. The sealing flange 41 is radially downwardly angled from the shaft 35 to its outer edge 47.

Figure 3:
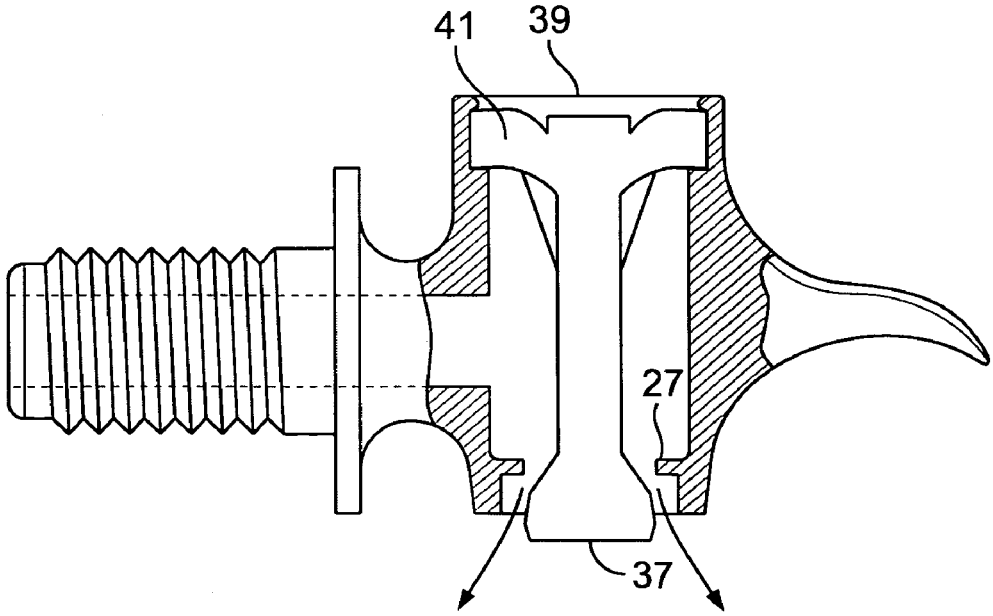
FIG. 3 (Prior Art)
FIG. 3 is a view similar to FIG. 2 showing the plunger of the prior art spigot in its open position.

The plunger 5 is inserted into the vertical passage 21 such that the lower surface 45 of the sealing flange 41 bears against the shelf 29 and the valve head 37 is positioned below the valve seat 27. The sealing flange 41 has an outer diameter selected such that its outer edge 47 seals against the inner surface of the vertical passage 21. The detent ring 31 bears against the upper surface 43 of the sealing flange 41 and helps keep the plunger 5 in place. The plunger 5 is moveable between a closed position (FIG. 2) wherein the valve head 37 is sealed against the valve seat 27 and an open position (FIG. 3) wherein the valve head 37 is spaced away from the valve seat 27 and liquid can flow therebetween.

The body 3 further includes a finger hook 51 which extends outwardly from the body 3 away from the connector 4. The spigot 1 is intended to be operated by a user placing an index finger under the finger hook 51 and pushing downwardly on the button 39 with his or her thumb. The resultant pressure on the sealing flange 41 causes the sealing flange 41 to flex and the gussets 49 to stretch, allowing the plunger 5 to move downwardly into its open position. As the plunger 5 moves downwardly, the valve head 37 moves away from the valve seat 27, allowing beverage to flow out of the container 11. When the user relaxes the pressure applied to the button 39, the elastomeric nature of the plunger 5 causes the sealing flange 41 and gussets 49 to go back to their original shapes, thereby pulling the plunger 5 upwardly and causing the valve head 37 to seal against the valve seat 27.

Figure 4:
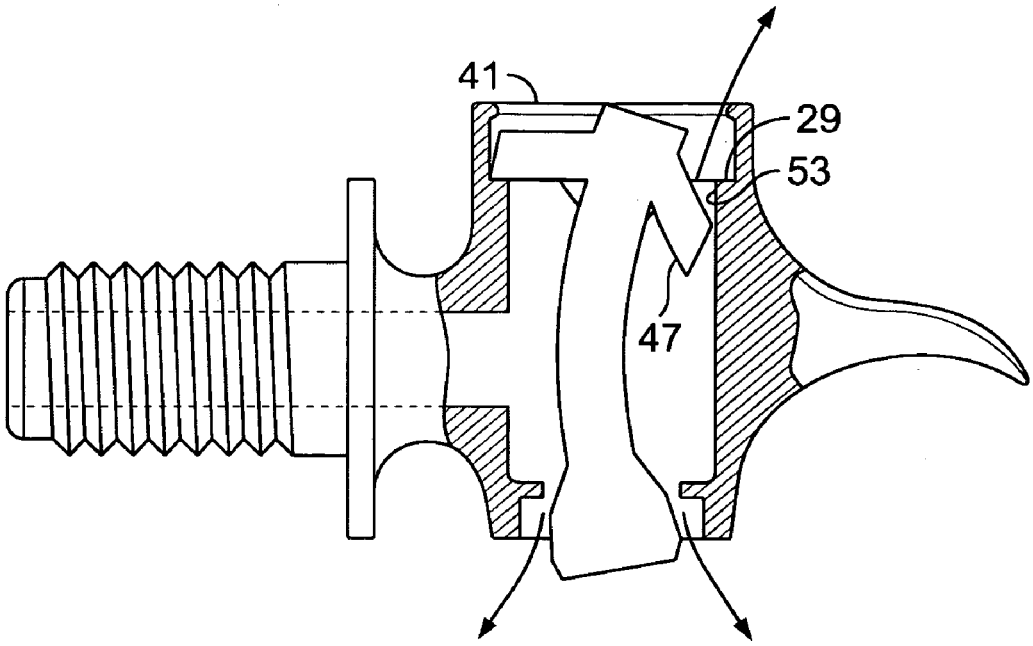
FIG. 4 (Prior Art)
FIG. 4 is a view similar to FIGS. 2 and 3 showing failure of the prior art spigot.

As shown in FIG. 4, a problem occurs with the prior art spigot 1 when the force applied to the button 39 is excessive or not substantially in axial alignment with the shaft 35. A portion of the sealing flange 41 proximate the outer edge 47 can be pushed downwardly past the shoulder 29, thereby creating a gap 53 between the sealing flange 41 and the body 3. The gap 53 allows beverage to leak or spray from the spigot 1 in an upward direction, often onto the user and dampening or staining his or her clothing. Additionally, when the sealing flange 41 is pushed downwardly as just described, the valve head 37 may be unable to seal against the valve seat 27, thereby allowing the remaining contents of the container 11 to run out onto the floor.

Referring to FIGS. 5–11, the present invention is an improved spigot having means for supporting the sealing flange when the plunger is in its open position in order to eliminate the above described problem. For example, the spigot 100 shown in FIGS. 5–8 includes a body 103 molded of hard plastic, such as polypropylene or the like and an elastomeric plunger 105. The body 103 is similar to the body 3 described above and includes a threaded connector 104, a horizontal passage 119 and a vertical passage 121 having a top end 123, a bottom end 125, an annular valve seat 127 proximate the bottom end 125, an annular shoulder 129 proximate the top end 123 and an annular detent ring 131 spaced above the annular shoulder 129. The plunger 105 is identical in shape to the plunger 5 described above and includes a shaft 135, a valve head 137, and a button 139 having a sealing flange 141 with an upper surface 143, a lower surface 145 and an outer edge 147. Gussets 149 are circumferentially spaced around the shaft 135 and are connected to the lower surface 145 of the sealing flange 141. The plunger 105 is molded of an elastomeric material such as rubber, neoprene, thermoplastic elastomer, or the like.

The spigot 100 differs from the spigot 1 in that the body 103 of the spigot 100 includes a plurality of ribs or fins 155 (four shown in FIG. 7) which extend radially into the vertical passage 121. Each of the fins 155 includes an upper end 157, a lower end 159, an outer edge 161 and opposed sides 163. The upper ends 157 of the fins 155 are positioned adjacent to the annular shoulder 129 and radially inward therefrom. As the plunger 105 is pushed downwardly toward its open position (as shown in FIG. 6), the upper ends 157 of the fins 155 contact and support the lower surface 145 of the sealing flange 141 proximate its outer edge 147, thereby preventing or inhibiting the outer edge 147 of the sealing flange 141 from being pushed downwardly into the vertical passage 121 past the shoulder 129.

Figure 5:
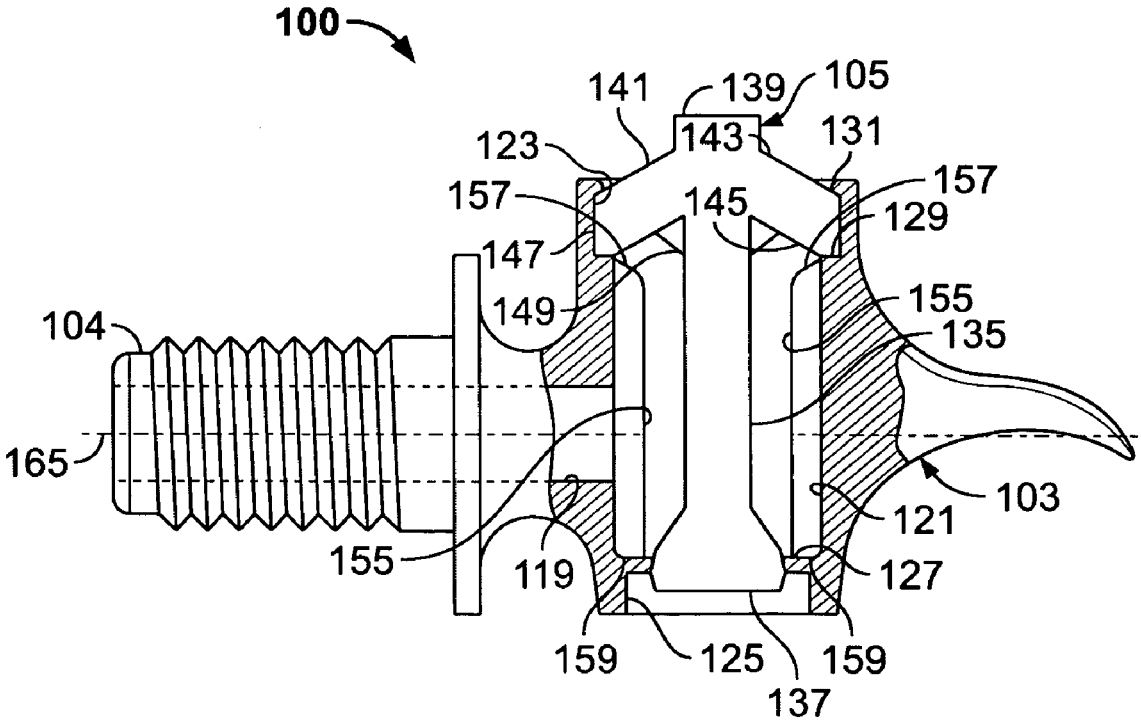
FIG. 5 is a side view of a spigot according to the present invention broken away to show its plunger in the closed position
Figure 6:
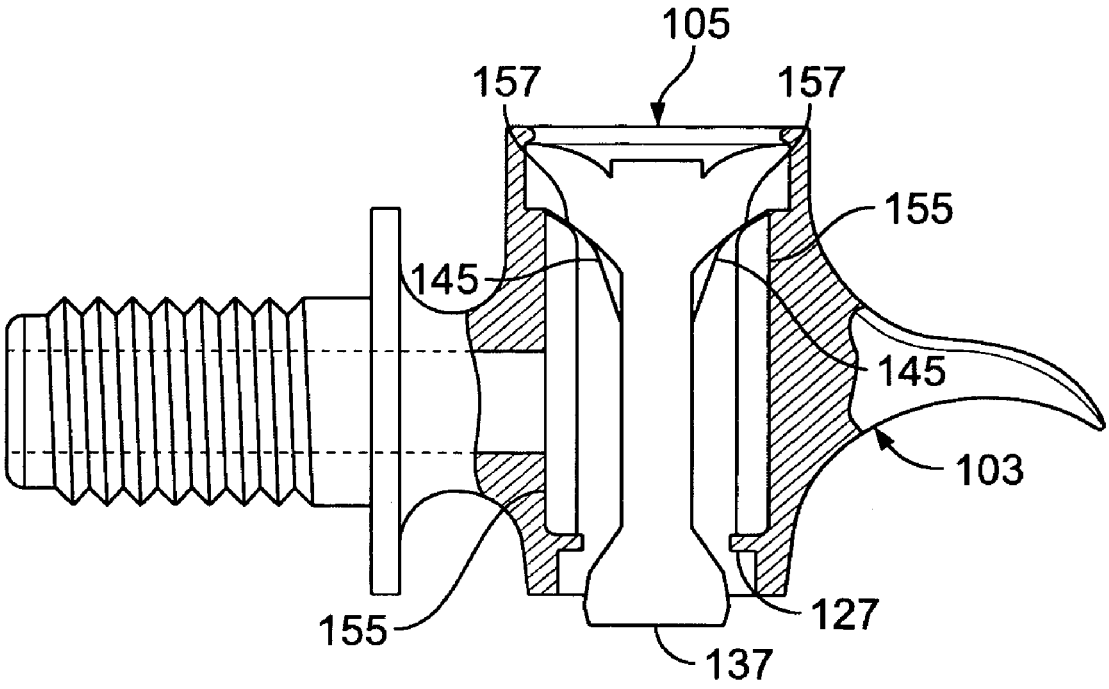
FIG. 6 is a view similar to FIG. 5 showing the plunger of the spigot in its open position
Figure 7:
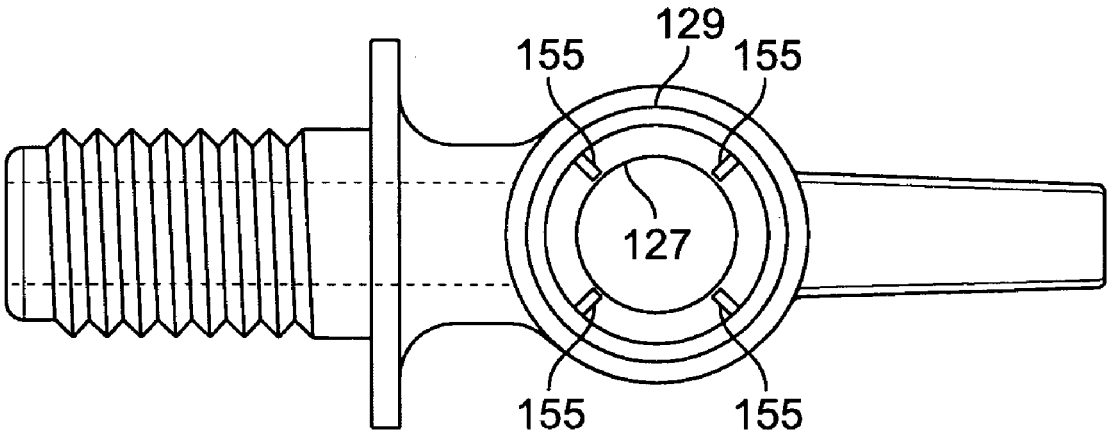
FIG. 7 is a top view of the spigot of the present invention with its plunger removed.
Figure 8:
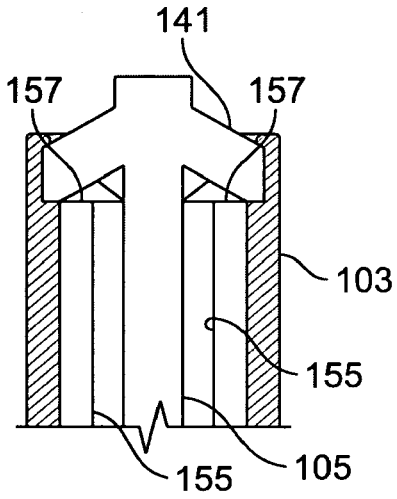
FIG. 8 is a fragmentary cross-sectional view of a spigot according to the present invention having fins with square upper ends.

The upper ends 157 of the fins 155 are shown in FIGS. 5 and 6 as being downwardly angled from the shoulder 129 so that the ends 157 do not contact the sealing flange 141 until the plunger 105 approaches its open position. It is important that the fins 155 support the sealing flange 141 as the plunger 105 is depressed without significantly interfering with the movement of the plunger 105. It should be noted, however, that if the fins 155 are sufficiently thin and the material of the plunger 105 is sufficiently soft, the upper ends 157 of the fins 155 may be square and level with the shoulder 129 (as shown in FIG. 8), since the fins 155 will sink into the sealing flange 141 without significantly inhibiting the motion of the plunger 105.

For ease of molding of the body 103, it is preferred that the fins 155 extend continuously along the vertical passage 121 such that the lower ends 159 are integrally molded with the valve seat 127. This design allows the body 103 to be injection molded in a relatively simple two-piece mold parting along a line 165, as seen in FIG. 5.

ALTERNATIVE EMBODIMENTS

Figure 9:
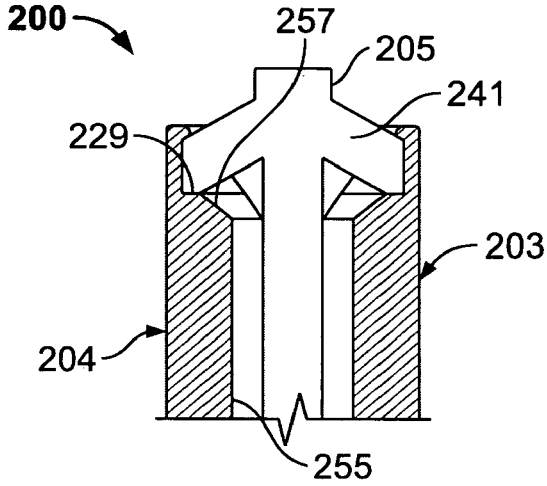
FIG. 9 is a fragmentary cross-sectional view of a first alternative embodiment of the present invention.
Figure 10:
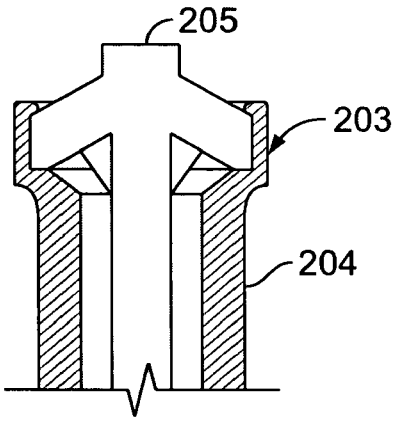
FIG. 10 is a view similar to FIG. 9 showing the first alternative embodiment with a reduced wall thickness.

While the internal fins 155 of the spigot 100 described above are the preferred means of supporting the sealing flange 141 as the plunger 105 is depressed, it is to be understood that other such means are foreseen. For example, FIG. 9 shows a fragmentary cross-sectional view of a spigot 200 having a body 203 and a plunger 205. The body 203 has a wall 204 which extends around a vertical passage 219 having an annular shoulder 229 which seats the sealing flange 241 of the plunger 205. The wall 204 includes an integral countersunk portion 255 positioned radially inward of the annular shoulder 229. The countersunk portion 255 has an end surface 257 which slopes downwardly away from the shoulder 229. The end surface 257 is thus positioned to support the sealing flange 241 when the plunger 205 is in its open position in a manner similar to upper ends 157 of the fins 155 described above. In general, the countersunk portion 255 equates to fins similar to the fins 155 having a thickness which is increased until the fins extend continuously around the vertical passage 219. This design would have a disadvantage, however, in that portions of the wall 204 are relatively thick and the body 203 would therefore be difficult to mold without sunken areas developing as the part cools. This problem could be corrected by molding the body 203 with a thinner and more uniform wall 204 as shown in FIG. 10.

Figure 11:
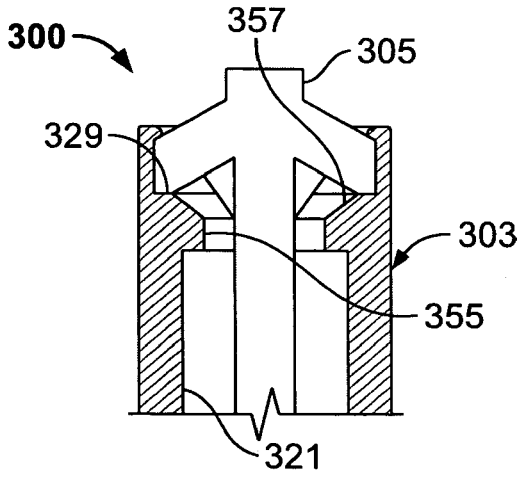
FIG. 11 is a fragmentary cross-sectional view of a second alternative embodiment of the present invention.

Referring to FIG. 11, a third embodiment of the present invention is a spigot 300 having a body 303 and a plunger 305. The body 303 includes a passage 321 and an annular shoulder 329 which seats the sealing flange 341 of the plunger 305. An annular ring 355 is positioned radially inward of the shoulder 329. A top surface 357 of the ring 355 slopes downwardly away from the shoulder 329 such that it is only contacted by the sealing flange 341 as the plunger 35 approaches its open position. When contact is made between the sealing flange 341 and the ring 355, the ring 355 will support the sealing flange 341 and inhibit its edges from being dislodged from the shoulder 329 and pushed downwardly into the passage 321. Again, the body 303 would be more difficult to mold than the body 3 described above, however the ring 355 would provide an adequate means for supporting the sealing flange 321. It is also foreseen that the ring 355 could be made as a separate part from the body 303 and installed in the passage 321 after the body 303 is molded.

It is to be understood that while certain forms of the present invention have been illustrated and described herein, it is not to be limited to the specific forms or arrangement of parts described and shown. For example, while the spigots 1, 100, 200 and 300 have been described as having a male threaded coupler engaged by a nut to attach the spigot to the beverage container, it is to be understood that the spigot could be connected in a variety of ways including but not limited to a female coupler in the spigot body engaged by a male threaded nut, or a snap fitting.

What is claimed and desired to be secured by Letters Patent is as follows:

1. A spigot for a beverage container comprising:

a) a body having a passage formed therethrough having first and second ends, said body including an annular shoulder extending into said passage proximate said first end thereof and an annular valve seat formed in said passage proximate said second end thereof; and b) an elastomeric plunger positioned in said passage, said plunger having first and second ends, said first end including a button with a sealing flange resting on said annular shoulder and seated against said body around its entire circumference in sealing engagement therewith, said second end of said plunger including a valve head biased against said valve seat and selectively moveable away from said valve seat by depression of said button; wherein c) said body includes support means for supporting said sealing flange when said button is depressed and thereby preventing any gap from opening between said sealing flange and said body.

2. The spigot as in claim 1 wherein said support means comprises a plurality of fins extending radially into said passage, each said fin having a first end adjacent said annular shoulder.

3. The spigot as in claim 2 wherein said first end of each said fin slopes away from said sealing flange and toward a centerline of said passage.

4. The spigot as in claim 2 wherein said first end of each said fin is level with said annular shoulder and said plunger is sufficiently soft that said first ends of said fins will push into said sealing flange as said button is depressed without significantly interfering with the movement of said plunger.

5. The spigot as in claim 2 wherein each said fin extends continuously from its respective first end to said valve seat.

6. The spigot as in claim 1 wherein said support means comprises a wall portion extending radially inward of said shoulder, said wall portion having an annular end surface adjacent to said shoulder, said end surface sloping away from said sealing flange and toward a centerline of said passage.

7. The spigot as in claim 1 wherein said support means comprises a ring positioned in said passage radially inward of said shoulder, said ring having an annular end surface adjacent to said shoulder, said end surface sloping away from said sealing flange and toward a centerline of said passage.

8. The spigot as in claim 7 wherein said ring is integrally molded with said body.

9. A spigot for a beverage container comprising:

a) a body having a passage formed therethrough having first and second ends, said body including an annular valve seat formed in said passage proximate said second end thereof; and b) an elastomeric plunger positioned in said passage, said plunger having first and second ends, said first end including a button with a sealing flange seated against said body around its entire circumference, said second end of said plunger including a valve head biased against said valve seat and selectively moveable away from said valve seat by depression of said button; wherein c) said body further includes a fin extending radially into said passage, said fin having a first end adjacent said sealing flange, said first end of said fin contacting said sealing flange as said button is depressed to support said sealing flange and thereby prevent any gap from opening between said sealing flange and said body.

10. The spigot as in claim 9 wherein said first end of said fin slopes away from said sealing flange and toward a centerline of said passage.

11. The spigot as in claim 9 wherein said plunger is sufficiently soft that said first ends of said fin will push into said sealing flange as said button is depressed without significantly interfering with the movement of said plunger.

12. The spigot as in claim 9 wherein said fin extends continuously from its respective first end to said valve seat.

13. The spigot as in claim 9 wherein there are a plurality of said fins.

14. The spigot as in claim 13 wherein there are four of said fins.

15. The spigot as in claim 9 wherein said fin is of a thickness such that said fin extends substantially completely around said passage.

16. A spigot for a beverage container comprising:

a) a body having a passage formed therethrough having first and second ends, said body including an annular shoulder extending into said passage proximate said first end thereof and an annular valve seat formed in said passage proximate said second end thereof; and b) an elastomeric plunger positioned in said passage, said plunger having first and second ends, said first end including a button with a sealing flange seated against said annular shoulder around its entire circumference in sealing engagement therewith, said second end including a valve head biased against said valve seat and selectively moveable away from said valve seat by depression of said button; wherein c) said body further includes a fin extending radially into said passage, said fin having a first end adjacent said annular shoulder, said first end of said fin making contact with said sealing flange as said button is depressed to support said sealing flange and prevent any gap from forming between said sealing flange and said annular shoulder.

* * * * *